US006557731B1

(12) United States Patent
Lyon et al.

(10) Patent No.: US 6,557,731 B1
(45) Date of Patent: May 6, 2003

(54) SINGLE USE GLUE DISPENSING PACKAGE

(76) Inventors: Robert Lyon, 6257 Gayton Pl., Malibu, CA (US) 90265; James Jones, 4459 Saratoga Ave., San Diego, CA (US) 92107; Georgia Jones, 4459 Saratoga Ave., San Diego, CA (US) 92107

( * ) Notice: Subject to any disclaimer, the term of this patent is extended or adjusted under 35 U.S.C. 154(b) by 0 days.

(21) Appl. No.: 10/056,507

(22) Filed: Jan. 25, 2002

Related U.S. Application Data

(63) Continuation-in-part of application No. 09/637,670, filed on Aug. 14, 2000, now abandoned.

(51) Int. Cl.[7] ..... B65D 35/22
(52) U.S. Cl. ..... 222/94; 222/107
(58) Field of Search ..... 222/92, 94, 107, 222/215

(56) References Cited

U.S. PATENT DOCUMENTS 3,128,920 A * 4/1964 Volckening ..... 222/215
3,189,227 A * 6/1965 Hobbs et al. ..... 222/94
3,224,640 A * 12/1965 Schneider et al. ..... 222/94
3,862,684 A * 1/1975 Schmitt ..... 222/107
3,913,734 A * 10/1975 Siegel ..... 206/470
4,921,137 A * 5/1990 Heijenga ..... 222/107
5,839,609 A * 11/1998 Zakensberg ..... 222/107

* cited by examiner

*Primary Examiner*—Kenneth Bomberg
(74) *Attorney, Agent, or Firm*—Goldstein & Lavas, P.C.

(57) ABSTRACT

A single use glue dispensing package including a plurality of individual packets removably coupled together to form a single sheet. Each of the individual packets have a free outer edge and opposed side edges. Each of the packets have a pouch formed therein. Each pouch holds a small quantity of glue therein, and is lined with a preservative for preventing the glue from hardening while in the pouch. Each pouch has tapered outer ends abutting the free outer edge of the of the packets. The free outer edge is formed with a lateral perforation whereby the removal of the free outer edge will open the tapered outer ends of the pouches to allow the glue to be removed therefrom.

6 Claims, 2 Drawing Sheets

SINGLE USE GLUE DISPENSING PACKAGE

CROSS REFERENCES AND RELATED SUBJECT MATTER

This application relates to subject matter contained in patent application Ser. No. 09/637,670, filed in the United States Patent Office on Aug. 14, 2000 now abandoned.

BACKGROUND OF THE INVENTION

The present invention relates to a single use glue dispensing package and more particularly pertains to a package which preserves a small quantity of glue until needed, and dispenses the same for use on a single application.

The use of glue dispensing devices is known in the prior art. More specifically, glue dispensing devices heretofore devised and utilized for the purpose of dispensing glue are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,160,763 to Mims discloses a glue applicator capable of minimizing the formation of glue drops. U.S. Pat. No. 3,946,700 to Cromeens and U.S. Pat. No. 4,271,982 to Niksich disclose additional glue applicator devices.

While these devices fulfill their respective, particular objective and requirements, the aforementioned patents do not describe a single use glue dispensing package which effectively preserves a small quantity of glue until needed, for dispensing the glue for use on a single application.

In this respect, the single use glue dispensing package according to the present invention substantially departs from the conventional concepts and designs of the prior art, and in doing so provides an apparatus primarily developed for the purpose of dispensing a small quantity of glue for use on a single application.

Therefore, it can be appreciated that there exists a continuing need for a new and improved single use glue dispensing package which can be used for dispensing a small quantity of glue for use on a single application. In this regard, the present invention substantially fulfills this need.

SUMMARY OF THE INVENTION

In the view of the foregoing disadvantages inherent it the known types of glue dispensing devices now present in the prior art, the present invention provides an improved single use glue dispensing package. As such, the general purpose of the present invention, which will be described subsequently in greater detail, is to provide a new and improved single use glue dispensing package which has all the advantages of the prior art and none of the disadvantages.

To attain this, the present invention essentially comprises a plurality of individual packets removably coupled together to form a single sheet. Each of the individual packets have a free outer edge and opposed side edges. Each of the individual packets are coupled with the single sheet by perforations to facilitate easy removal of the individual packets from the single sheet. Each of the packets have a bottle-shaped pouch formed therein. Each pouch holds a small quantity of glue therein, and is lined with a preservative for keeping the glue from hardening, congealing, or otherwise solidifying prior to use. Each pouch has tapered outer ends abutting the free outer edge of the of the packets. The free outer edge is formed with a lateral perforation whereby the removal of the free outer edge will open the tapered outer ends of the pouches to allow the glue to be removed therefrom. The individual packets each are formed with a pair of opposed diagonal perforations extending from the free outer edge to the opposed side edges.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved single use glue dispensing package which has all the advantages of the prior art glue dispensing devices and none of the disadvantages.

It is another object of the present invention to provide a new and improved single use glue dispensing package which may be easily and efficiently manufactured and marketed.

It is a further object of the present invention to provide a new and improved single use glue dispensing package which is of durable and reliable construction.

An even further object of the present invention is to provide a new and improved single use glue dispensing package which is susceptible of a low cost of manufacture with regard to both materials and labor, and which accordingly is then susceptible of low prices of sale to the consuming public, thereby making such a single use glue dispensing package economically available to the buying public.

Even still another object of the present invention is to provide a new and improved single use glue dispensing package for preserving a small quantity of glue until ready for use, and dispensing for use on a single application.

Lastly, it is an object of the present invention to provide a new and improved single use glue dispensing package including a plurality of individual packets removably coupled together to form a single sheet. Each of the individual packets have a free outer edge and opposed side edges. Each of the packets have a pouch formed therein. Each pouch holds a small quantity of glue therein, and is lined with a glue preservative. Each pouch has tapered outer ends abutting the free outer edge of the of the packets. The free outer edge is formed with a lateral perforation whereby the removal of the free outer edge will open the tapered outer ends of the pouches to allow the glue to be removed therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figures 1, 2, 3:
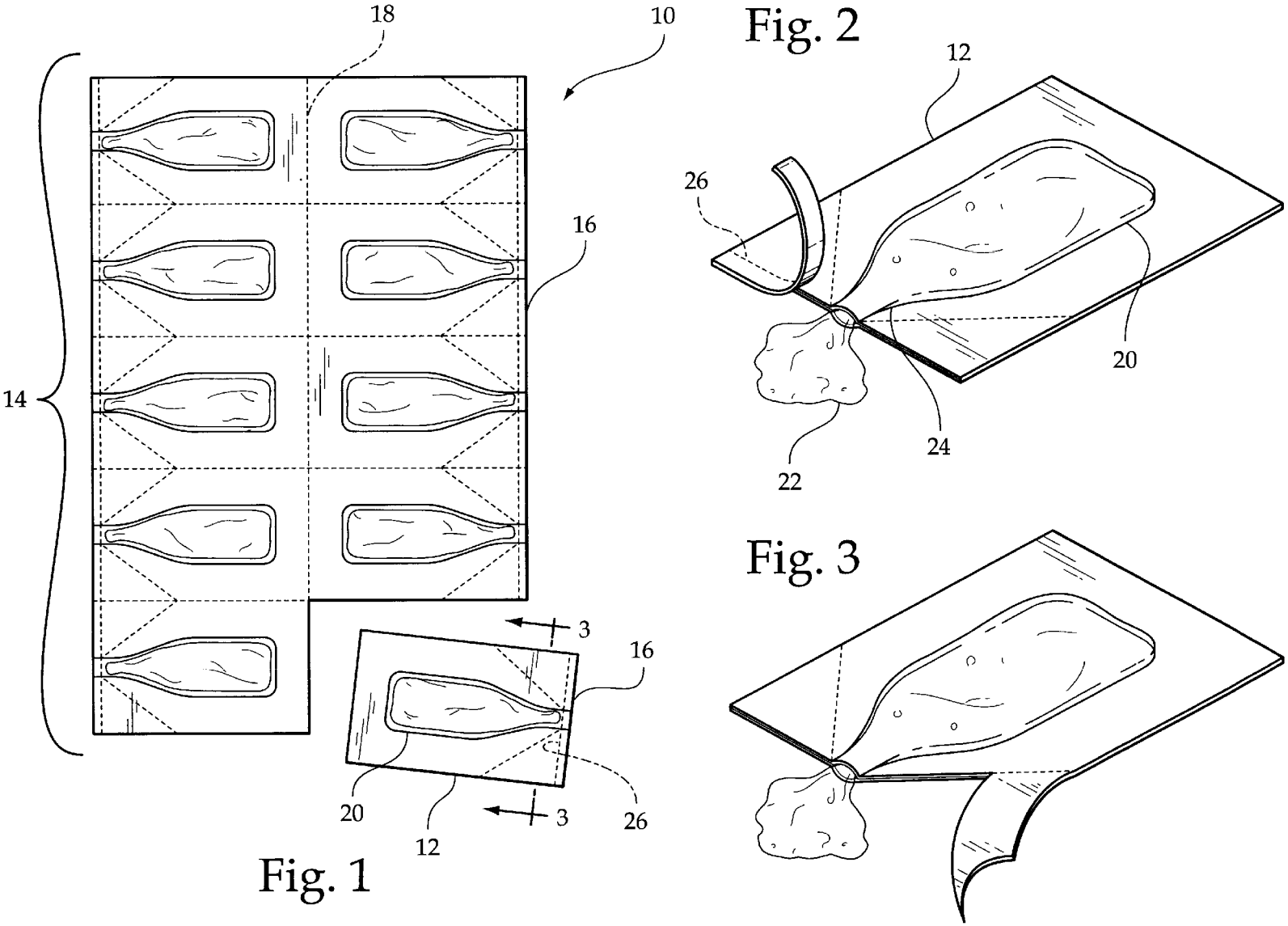
FIG. 1 is a plan view of the preferred embodiment of the single use glue dispensing package constructed in accordance with the principles of the present invention.
FIGS. 2 and 3 are perspective views of one of the packets of the present invention illustrated in use.
Figure 4:
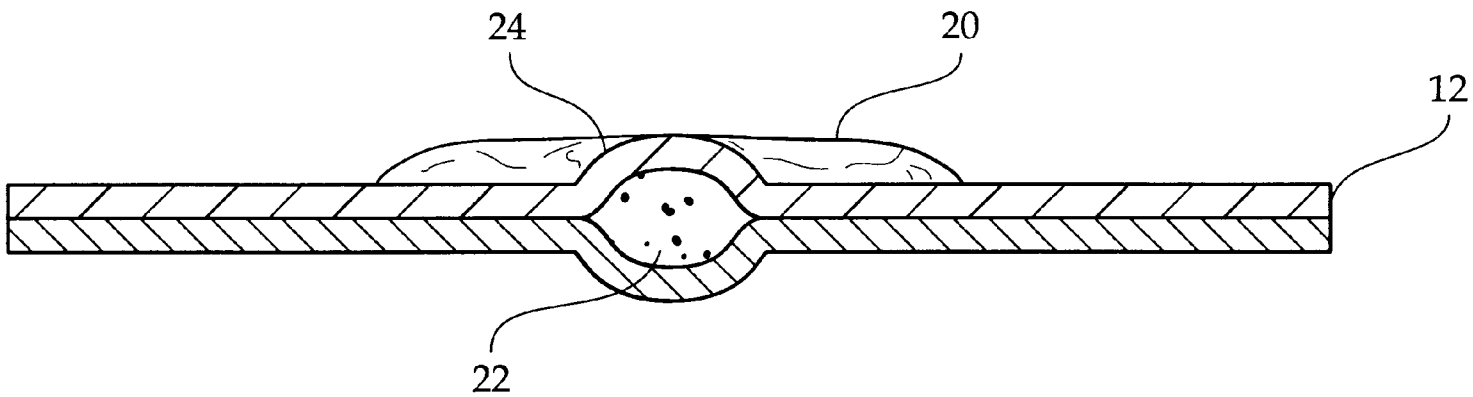
FIG. 4 is a cross-sectional view of the present invention as taken along line 3—3 of FIG. 1.

With reference now to the drawings, and in particular, to FIGS. 1 through 4 thereof, the preferred embodiment of the new and improved single use glue dispensing package embodying the principles and concepts of the present invention and generally designated by the reference number 10 will be described.

Specifically, it will be noted in the various figures that the device relates to a single use glue dispensing package for dispensing a small quantity of glue for use on a single application.

The present invention is essentially comprised of a plurality of individual packets 12 removably coupled together to form a single sheet 14. Note FIG. 1. Each of the individual packets 12 have a free outer edge 16 and opposed side edges 17. Each of the individual packets 12 are coupled with the single sheet 14 by perforations 18 to facilitate easy removal of the individual packets 12 from the single sheet 14. Essentially, at least one side edge and the inner edges of the packets 12 are joined together. Note FIG. 1. Each of the packets 12 have a bottle-shaped pouch 20 formed therein. Each pouch 20 holds a small quantity of glue 22 therein. Note FIG. 4. Each pouch 20 is lined with a preservative, chosen to keep the glue from solidifying before it is dispensed from the pouch 20. Each pouch 20 has tapered outer ends 24 abutting the free outer edge 16 of the packets 12. The free outer edge 16 is formed with a lateral perforation 26 whereby the removal of the free outer edge 16 will open the tapered outer ends 24 of the pouches 20 to allow the glue 22 to be removed therefrom. Note FIG. 2. The individual packets 12 each are formed with a pair of opposed diagonal perforations 28 extending from the free outer edge 16 to the opposed side edges 17.

Accordingly to the most preferred embodiment of the invention, the glue 22 is a cyanoacrylicate glue, often known as "CRAZY GLUE". To prevent such glue from hardening, the preservative which lines the pouch 20 is vinyl chloride, which will effectively prevent the cyanoacrylicate glue from congealing, hardening, or otherwise solidifying before it is dispensed from the packet 12.

In use, an individual packet 12 is removed from the single sheet 14 prior to use. The user then tears the free outer edge 16 away at the lateral perforation 26 to allow the glue 22 to be released from the pouch 20. The glue 22 can be applied for use in any chosen application. After use, the packet 12 can be disposed of without having to replace a cap or any other saving measure that otherwise would be needed for a standard glue container or tube. Additionally, the diagonal perforations 28 allow for the tapered outer end 24 to be narrowed for use in hard to reach areas. Once the free outer edge 16 has been torn away, the user then further tears the individual packet 12 at the diagonal perforations 28. This will essentially remove the corners 30 of the individual packets 12. Note FIG. 3. Furthermore, the single sheet 14 could be provided with a handle that will allow the device 10 to hang from a support at a point-of-sale location.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A single use glue dispensing package for dispensing a small quantity of glue for use on a single application comprising, in combination:

a plurality of individual packets removably coupled together to form a single sheet, each of the individual packets having a free outer edge and opposed side edges, each of the individual packets being coupled with the single sheet by perforations to facilitate easy removal of the individual packets from the single sheet, each of the packets having a bottle-shaped pouch formed therein, each pouch holding a small quantity of cyanoacrylicate glue therein, each pouch lined with vinyl chloride to prevent the glue from hardening while in the pouch, each pouch having tapered outer ends abutting the free outer edge of the of the packets, the free outer edge being formed with a lateral perforation whereby the removal of the free outer edge will open the tapered outer ends of the pouches to allow the glue to be removed therefrom, the individual packets each being formed with a pair of opposed diagonal perforations extending from the free outer edge to the opposed side edges.

2. A single use glue dispensing package for dispensing a small quantity of glue for use on a single application comprising, in combination:

a plurality of individual packets removably coupled together to form a single sheet, each of the individual packets having a free outer edge and opposed side edges, each of the packets having a pouch formed therein, each pouch holding a small quantity of glue therein, each pouch being lined with a preservative for preventing the glue from hardening while in the pouch, each pouch having outer ends abutting the free outer edge of the of the packets, the free outer edge being formed with a lateral perforation whereby the removal of the free outer edge will open the tapered outer ends of the pouches to allow the glue to be removed therefrom.

3. The single use glue dispensing package as set forth in claim 2, wherein each of the individual packets are coupled with the single sheet by perforations to facilitate easy removal of the individual packets from the single sheet.

4. The single use glue dispensing package as set forth in claim 2, wherein each pouch is bottle-shaped.

5. The single use glue dispensing package as set forth in claim 2, wherein the individual packets each are formed with at least one diagonal perforation extending from the free outer edge to one of the opposed side edges.

6. The single use glue dispensing package as set forth in claim 5, wherein the preservative that lines the pouch is vinyl chloride.

* * * * *